US009659761B2

(12) United States Patent
Kostyukevich et al.

(10) Patent No.: US 9,659,761 B2
(45) Date of Patent: May 23, 2017

(54) DYNAMICALLY HARMONIZED FT-ICR CELL WITH SPECIALLY SHAPED ELECTRODES FOR COMPENSATION OF INHOMOGENEITY OF THE MAGNETIC FIELD

(71) Applicant: Bruker Daltonik GmbH, Bremen (DE)

(72) Inventors: Yury Kostyukevich, Odintsovo (RU); Evgeny Nikolaev, Moscow (RU); Gleb Vladimirov, Chimki (RU)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 14/024,419

(22) Filed: Sep. 11, 2013

(65) Prior Publication Data

US 2014/0070090 A1 Mar. 13, 2014

Related U.S. Application Data

(60) Provisional application No. 61/699,597, filed on Sep. 11, 2012.

(51) Int. Cl.

| | |
|---|---|
| ***H01J 49/38*** | (2006.01) |
| *H01J 49/34* | (2006.01) |
| *H01J 49/00* | (2006.01) |

(52) U.S. Cl.

CPC ..... *H01J 49/38* (2013.01); *H01J 49/0027* (2013.01); *H01J 49/34* (2013.01)

(58) Field of Classification Search

None

See application file for complete search history.

(56) References Cited

U.S. PATENT DOCUMENTS

| | | | | |
|---|---|---|---|---|
| 3,937,955 | A * | 2/1976 | Comisarow | G01N 24/002 250/283 |
| 5,019,706 | A * | 5/1991 | Allemann et al. | 250/291 |
| 8,766,174 | B1 * | 7/2014 | Baykut | H01J 49/38 250/282 |
| 2005/0178961 | A1 * | 8/2005 | Beu | H01J 49/38 250/291 |
| 2007/0278402 | A1 * | 12/2007 | Zubarev et al. | 250/291 |
| 2012/0193529 | A1 * | 8/2012 | Nikolaev et al. | 250/282 |

FOREIGN PATENT DOCUMENTS

WO WO 2011045144 A1 * 4/2011

OTHER PUBLICATIONS

Boldin et al., "Fourier Transform Ion Cyclotron Resonance Cell with Dynamic Harmonization of the Electric Field in the Whole Volume by Shaping of the Excitation and Detection Electrode Assembly", Rapid Commun. Mass Spectrom. 2011, 25, 122-126.*

EP office action for EP13004356.5 dated Feb. 22, 2016.

(Continued)

*Primary Examiner* — Wyatt Stoffa
*Assistant Examiner* — James Choi
(74) *Attorney, Agent, or Firm* — O'Shea Getz P.C.

(57) ABSTRACT

A method and apparatus of compensating a magnetic field inhomogeneity in a dynamically harmonized FT-ICR cell is presented, based on adding of extra electrodes into the cell, the extra electrodes being shaped in such a way that the averaged electric field created by these electrodes produces a counter force to the forces caused by the inhomogeneous magnetic field on the cycling ions.

12 Claims, 5 Drawing Sheets

(56) References Cited

OTHER PUBLICATIONS

Kostyukevich et al., "Dynamically Harmonized FT-ICR Cell with Specially Shaped Electrodes for Compensation of Inhomogeneity of the Magnetic Field. Computer Simulations of the Electric Field and Ion Motion Dynamics", Journal of the American Society for Mass Spectrometry, vol. 23, No. 12, Sep. 2012, pp. 2198-2207.
Nikolaev et al., "Initial Experimental Characterization of a New Ultra-High Resolution FTICR Cell with Dynamic Harmonization", Journal of the American Society for Mass Spectrometry, vol. 22, No. 7, Apr. 2011, pp. 1125-1133.
Boldin et al., "Fourier transform ion cyclotron resonance cell with dynamic harmonization of the electric field in the whole volume by shaping of the excitation and detection electrode assembly", Rapid Communications in Mass Spectrometry, vol. 25, No. 1, Jan. 2011, pp. 122-126.
Kaiser et al., "Electrically Compensated Fourier Transform Ion Cyclotron Resonance Cell for Complex Mixture Mass Analysis", Analytical Chemistry, vol. 83, No. 17, Aug. 2011, pp. 6907-6910.
EP Office Action dated Feb. 9, 2016.

* cited by examiner

DYNAMICALLY HARMONIZED FT-ICR CELL WITH SPECIALLY SHAPED ELECTRODES FOR COMPENSATION OF INHOMOGENEITY OF THE MAGNETIC FIELD

PRIORITY INFORMATION

This application claims priority under 35 U.S.C. §119(e) to U.S. Patent Application. No. 61/699,597 filed Sep. 11, 2012, which is hereby incorporated by reference.

FIELD OF INVENTION

The invention relates to Fourier-transform ion cyclotron resonance (FT-ICR) mass spectrometry, particularly to FT-ICR cells with electrodes shaped to achieve a hyperbolic electric field distribution on average for the cycling ions, cells which have become known as dynamically harmonized cells.

BACKGROUND OF THE INVENTION

Fourier transform ion cyclotron resonance mass-spectrometry is an established powerful experimental technique for solving a wide range of problems in analytical chemistry and biochemistry, such as determination of the composition of complex mixtures, identification of biological compounds, and accurate mass measurement. See for example Kaiser, N. K., Savory, J. J., McKenna, A. M., Quinn, J. P., Hendrickson, C. L., Marshall, A. G.: *Electrically Compensated Fourier Transform Ion Cyclotron Resonance Cell for Complex Mixture Mass Analysis*, Anal. Chem. 83(17), 6907-6910 (2011); Marshall, A. G., Hendrickson, C. L., Jackson, G. S.: *Fourier Transform Ion Cyclotron Resonance Mass Spectrometry: a Primer*, Mass Spectrum. Rev. 17(1), 1-35 (1998); Bogdanov, B., Smith, R. D.: *Proteomics by FTICR Mass Spectrometry: Top Down and Bottom Up. Mass Spectrum*, Rev. 24(2), 168-200 (2005); Marshall, A. G., Rodgers, R. P.: *Petroleomics: The Next Grand Challenge for Chemical Analysis*; Acc. Chem. Res. 37(1), 53-59 (2004); Kim, S., Kramer, R. W., Hatcher, P. G.: *Graphical method for Analysis of Ultrahigh-Resolution Broadband Mass Spectra of Natural Organic Matter, the Van Krevelen Diagram*, Anal. Chem. 75, 5336-5344 (2003); Nikolaev, E. N., Jertz, R., Grigoryev, A., Baykut, G.: *Fine Structure in Isotopic Peak Distributions Measured Using a Dynamically Harmonized Fourier Transform Ion Cyclotron Resonance Cell at 7 T*, Anal. Chem. 84(5), 2275-2283 (2012).

A main component of the ICR mass spectrometer is a measuring cell, which is a Penning ion trap in which ions are trapped by a combination of electric and magnetic fields. In order to measure the masses of the ions after they are trapped in the cell, cyclotron motion of the ions is excited by a radio frequency (RF) field and the frequency of this motion is determined by measuring the current induced in the external electric circle connected to the detection electrodes of the cell. After the Fourier transform of this time domain signal one obtains its frequency spectrum, and after calibration a mass spectrum.

The configuration of the electric field inside the ion trap strongly influences the analytical characteristics of the ICR mass spectrometer, its resolving power and mass accuracy. See Gabrielse, G., Haarsma, L., Rolston, S. L.: *Open-Endcap Penning Traps for High Precision Experiments, Int. J. Mass Spectrum*, Ion Processes 88, 319-332 (1989); Brustkern, A. M., Rempel, D. L., Gross, M. L.: *An Electrically Compensated Trap Designed to Eighth Order for FT-ICR Mass Spectrometry*, J. Am. Soc Mass Spectrum 19(9), 1281-1285 (2008). The longer the duration of an undisturbed ion current measurement, the higher is the mass resolution.

Recently performed supercomputer simulations of ion cloud motion in a Penning trap showed that the hyperbolic field is the best for achieving long duration of synchronous ion motion and obtaining high resolving power. See Nikolaev, E. N., Heeren, R. M. A., Popov, A. M., Pozdneev, A. V., Chingin, K. S.: *Realistic Modeling of Ion Cloud Motion in a Fourier Transform Ion Cyclotron Resonance Cell by Use of a Particle-in-Cell Approach*, Rapid Commun. Mass Spectrum. 21, 3527-3546 (2007); Nikolaev, E. N., Miluchihin, N., Inoue, M.: *Evolution of an Ion Cloud in a Fourier Transform Ion Cyclotron Resonance Mass Spectrometer During Signal Detection: its Influence on Spectral Line Shape and Position*. Int. J. Mass Spectrum. Ion Processes 148(3), 145-157 (1995); Vladimirov, G., Hendrickson, C. L., Blakney, G. T., Marshall, A. G., Heeren, R. M., Nikolaev, E. N.: *Fourier Transform Ion Cyclotron Resonance Mass Resolution and Dynamic Range Limits Calculated by Computer Modeling of Ion Cloud Motion*, J. Am. Soc. Mass Spectrum. 23(2), 375-384 (2012). Making the electric field distribution inside the FT ICR cell close to the field in a hyperbolic cell is called "cell harmonization".

One approach to cell harmonization is based on the so-called dynamic harmonization of the electric field. See Boldin, I. A., Nikolaev, E. N.: *Fourier Transform Ion Cyclotron Resonance Cell With Dynamic Harmonization of the Electric Field in the Whole Volume by Shaping of the Excitation and Detection Electrode Assembly*, Rapid Commun. Mass Spectrum. 25, 122-126 (2011); see also international patent application WO 2011/045144 A1, both incorporated herein by reference. The cell field becomes hyperbolic after being averaged by the cyclotron motion. The principal design of such a cell was previously described in, which is incorporated herein by reference in its entirety, and is presented in FIG. 1A.

As described in documents identified in the preceding paragraph this cell is a cylinder segmented by curves along an axial (magnetic field) direction z $$\alpha = \frac{2\pi}{N}n \pm b\left(1 - \left(\frac{z}{a}\right)^2\right);\ n = 0, 1, \ldots, N-1;\ \ b = \frac{\pi}{N} - \frac{\pi}{60} \tag{1}$$

Here z is the axial coordinate of the cell, a half the length of the cell, α is the angle coordinate of a point on the curve, and N the number of electrodes of each type. The original experimentally tested ion trap with dynamic harmonization had eight segments with width decreasing to the center of the cell and eight grounded electrodes with width increasing to the center, four of which are divided into two segments, each of which belongs to either excitation or detection groups of electrodes. The trapping potential V is applied to a first group of electrodes and to the trapping electrodes. Other electrodes are grounded to direct current (DC) voltage; RF voltages are applied via capacitors to the excitation groups of electrodes, and the detection group electrodes are connected with each other and with a preamplifier by capacitors of appropriate value of capacity.

The ion trap with dynamic harmonization showed the highest resolving power ever achieved on peptides and proteins. See Nikolaev, E. N., Boldin, I. A., Jertz, R., Baykut, G.: *Initial Experimental Characterization of a New Ultra-High Resolution FTICR Cell With Dynamic Harmo-*

*nization*, J. Am. Soc. Mass Spectrum. 22(7), 1125-1133 (2011). The time of transient duration reaches 300 seconds and seems to be limited only by the vacuum inside the FT ICR cell and magnetic field inhomogeneity. See Vladimirov, G., Kostyukevich, Y., Marshall, A. G., Hendrickson, C. L., Blakney, G. T., Nikolaev, E. N.: *Influence of Different Components of Magnetic Field Inhomogeneity on Cyclotron Motion Coherence at Very High Magnetic Field*, Proceedings of the 58th ASMS Conference on Mass Spectrometry and Allied Topics; Salt Lake City, Utah, May (2010). Such results were obtained on a solenoid magnet of high homogeneity (less than 1 ppm of magnetic field deviation in the central region [6 cm in diameter and 6 cm length]). In order to obtain a long time domain signal using the dynamically harmonized cell on the other systems, the magnetic field of their magnets should be corrected correspondingly. Among the systems of interest are FT ICR mass spectrometers on permanent magnets, with inhomogeneity of the magnetic field about 500 ppm in a 1 $cm^3$ cube (see Vilkov, A. N., Gamage, C. M., Misharin, A. S., Doroshenko, V. M., Tolmachev, D. A., Tarasova, I. A., Kharybin, O. N., Novoselov, K. P., Gorshkov, M. V.: *Atmospheric Pressure Ionization Permanent Magnet Fourier Transform Ion Cyclotron Resonance Mass Spectrometry*, J. Am. Soc. Mass Spectrum. 18(8), 1552-1558 (2007)) and on cryogenic free magnets with inhomogeneity of 100 ppm in a cylindrical volume 25 mm in diameter and 40 mm in length. These instruments demonstrated the resolving power of about 100,000 for m/z around 500. For such ICR mass spectrometers the inhomogeneity of the magnetic field is the main factor influencing the time of signal acquisition and resolving power. The inhomogeneity of the magnetic field was also the main limiting factor for an ICR mass spectrometer equipped with a 25 Tesla resistive magnet. See Shi, S. D.-H., Drader, J. J., Hendrickson, C. L., Marshall, A. G.: *Fourier Transform Ion Cyclotron Resonance Mass Spectrometry in a High Homogeneity 25 Tesla Resistive Magnet*, J. Am. Soc. Mass Spectrum. 10, 265-268 (1999). The inhomogeneity of the magnetic field in a sphere of 1 cm in diameter was approximately 50 ppm for this magnet. Correction of the magnetic field to achieve higher homogeneity is an expensive and complicated procedure.

Recently it was demonstrated that in the case of Gabrielse's type FT ICR cell, the influence of the inhomogeneity of the magnetic field may be decreased by compensating the electric field by accurately adjusting the compensation voltage on one of the electrodes of a seven segment cell. See Kaiser, N. K., Savory, J. J., McKenna, A. M., Quinn, J. P., Hendrickson, C. L., Marshall, A. G.: *Electrically Compensated Fourier Transform Ion Cyclotron Resonance Cell for Complex Mixture Mass Analysis*, Anal. Chem. 83(17), 6907-6910 (2011); Brustkern, A. M., Rempel, D. L., Gross, M. L.: *An Electrically Compensated Trap Designed to Eighth Order for FT-ICR Mass Spectrometry*, J. Am. Soc Mass Spectrum 19(9), 1281-1285 (2008); Tolmachev, A. V., Robinson, E. W., Wu, S., Kang, H., Lourette, N. M., Paša-Tolić, L., Smith, R. D.: *Trapped-ion cell with improved DC potential harmonicity for FT-ICR MS*, J. Am. Soc. Mass Spectrum. 19(4), 586-597 (2008).

In view of the foregoing, there is still a need for a method for the compensation of magnetic field inhomogeneities in dynamically harmonized FT ICR cells.

SUMMARY OF THE INVENTION

An ion trap for FT-ICR mass spectrometers with dynamic harmonization showed the highest resolving power ever achieved both for ions with moderate masses of about 500-1000 Da (peptides) as well as ions with very high masses of up to about 200 kDa (proteins). Such results were obtained for superconducting magnets of high homogeneity of the magnetic field. For magnets with lower homogeneity, the time of transient duration and hence the mass resolution would be smaller. In superconducting magnets used in FT-ICR mass spectrometry the inhomogeneity of the magnetic field in its axial direction prevails over the inhomogeneity in other directions and should be considered as the main factor influencing the synchronic motion of the ion cloud. The inhomogeneity leads to a dependence of the cyclotron frequency from the amplitude of axial oscillation in the potential well of the ion trap. As a consequence, ions in an ion cloud become dephased, which leads to signal attenuation and decrease in the resolving power. Ion cyclotron frequency is also affected by the radial component of the electric field. Hence, by appropriately adjusting the electric field one can compensate the inhomogeneity of the magnetic field and align the cyclotron frequency in the whole range of amplitudes of z-oscillations. A method of magnetic field inhomogeneity compensation in a dynamically harmonized FT-ICR cell is presented, based on adding of extra electrodes into the cell shaped in such a way that the averaged electric field created by these electrodes produces a counter force to the forces caused by the inhomogeneous magnetic field on the cycling ions.

These and other objects, features and advantages of the present invention will become more apparent in light of the following detailed description of preferred embodiments thereof, as illustrated in the accompanying drawings.

BRIEF DESCRIPTION OF THE DRAWING

The invention can be better understood by referring to the following figures. The elements in the figures are not necessarily to scale, emphasis instead being placed upon illustrating the principles of the invention (often schematically). In the figures, corresponding parts are generally designated by identical last two digits of the reference numerals throughout the different views.

Figure 1A:
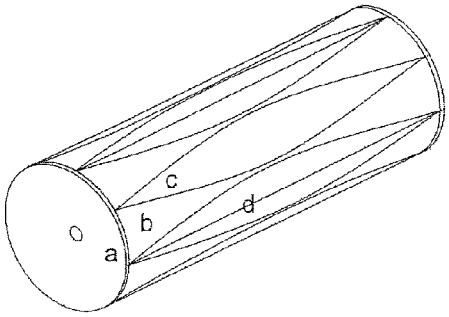
Figure 1A (Prior Art)
FIG. 1A illustrates a prior art ICR cell with dynamic harmonization. Letter a denotes trapping electrodes with a surface geometry close to spherical; b are segments for electrostatic field harmonization; c are grounded segments; and d denotes a slit separating a detection electrodes assembly from an excitation electrode assembly.

curves (202): $\gamma=1\cdot10^{-9}$ mm$^{-2}$, curves (204): $\gamma=2\cdot10^{-9}$ mm$^{-2}$, curves (206): $\gamma=3\cdot10^{-9}$ mm$^{-2}$, curves (208): $\gamma=4\cdot10^{-9}$ mm$^{-2}$. See Equation (8) below.

FIGS. 3A-3F illustrate the dependence of the ion cloud dephasing time on the compensation electrode voltage for different values of the z oscillation amplitude (zero to peak), radius and m/z, for a linear inhomogeneity $B=B(1+\gamma z)$. Shown is the time of synchronic motion vs. voltage on the right set of compensation electrodes. $V_l+V_r=2\cdot V_{trap}$. Inhomogeneities (from left to right in all plots): curves (300): $\gamma=1\cdot10^{-7}$ mm$^{-1}$, curves (302): $\gamma=3\cdot10^{-7}$ mm$^{-1}$, curves (304): $\gamma=5\cdot10^{-7}$ mm$^{-1}$, curves (306): $\gamma=7\cdot10^{-7}$ mm$^{-1}$, curves (308): $\gamma=9\cdot10^{-7}$ mm$^{-1}$.

Figure 4:
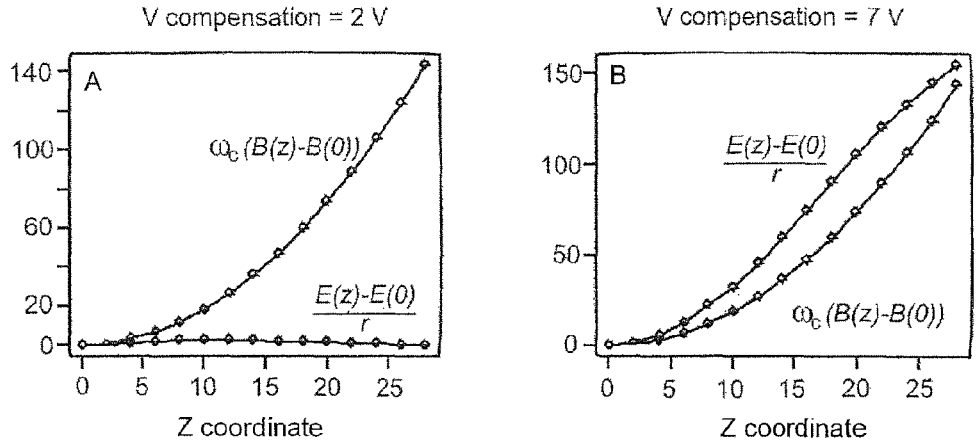

FIG. 4A-4B illustrates compensation conditions for the case of $\gamma=2\cdot10^{-9}$ mm$^{-2}$, Z units are given in millimeter, magnetic field units in Tesla, frequency units in s$^{-1}$, and E/r in Volts per square meter.

Figure 5A:
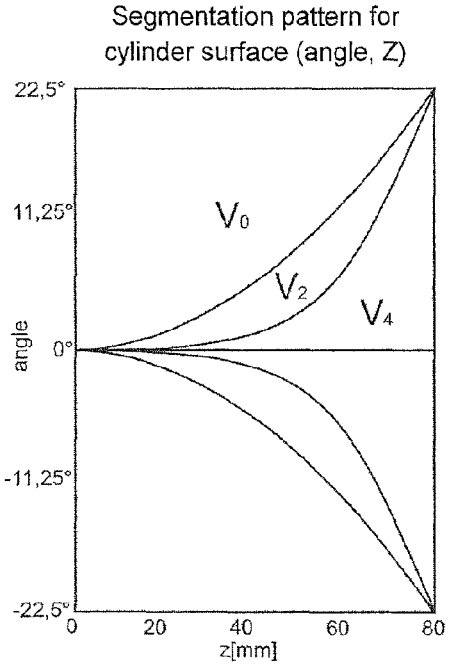
Figure 5B:
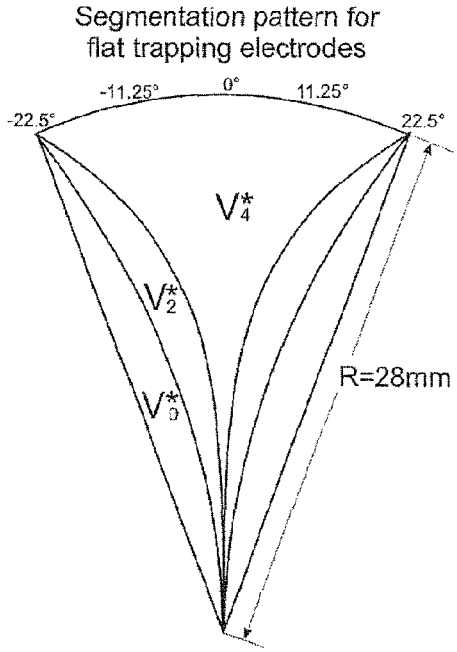

FIGS. 5A-5B illustrate the schematic design of the ion trap with dynamic harmonization capable to create exact field of form as given by Equation (9). The segmentation pattern is shown for the cylindrical surface (FIG. 5A) and the trapping electrode (FIG. 5B) for a N=8 segment cell. Variables $V_0$, $V_2$, $V_4$ are voltages applied to segments on a cylindrical surface. Variables $V^*_0$, $V^*_2$, $V^*_4$ are voltages applied to segments on a flat trapping electrode. Segments of the cell are shaped by curves of second and fourth order.

Figure 6:
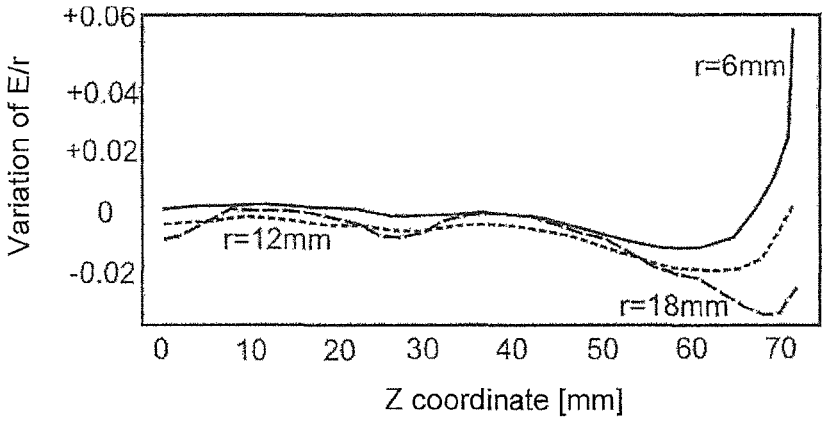

FIG. 6 illustrates the dependence of radial component of electric force in original ion trap with dynamic harmonization on z for different radii.

$$\frac{E_r(z)/r}{E_{r_1}(0)/r_1}-1,\ r_1=6\text{ mm}.$$

DETAILED DESCRIPTION OF THE INVENTION

While the invention shall be shown and described with reference to a number of embodiments thereof, it will be recognized by those skilled in the art that various changes in form and detail may be made herein without departing from the spirit and scope of the invention as defined by the appended claims.

The influence of the inhomogeneity of the magnetic field may be decreased by compensating the electric field by accurately adjusting a compensation voltage on special electrodes applied to the dynamically harmonized cell. A design of the ICR cell with magnetic field inhomogeneity compensation based on the principle of the dynamic field creation is presented. Additional segments with a potential different from that on the main segments are introduced into the original ion trap with dynamic harmonization (see Boldin, I. A., Nikolaev, E. N.: *Fourier Transform Ion Cyclotron Resonance Cell With Dynamic Harmonization of the Electric Field in the Whole Volume by Shaping of the Excitation and Detection Electrode Assembly*, Rapid Commun. Mass Spectrum. 25, 122-126 (2011); see also international patent application WO 2011/045144 A1; Nikolaev, E. N., Boldin, I. A., Jertz, R., Baykut, G.: *Initial Experimental Characterization of a New Ultra-High Resolution FTICR Cell with Dynamic Harmonization*, J. Am. Soc. Mass Spectrum. 22(7), 1125-1133 (2011)), thus creating an additional electric field inside the cell. These segments are shaped by curves of fourth order to the z-coordinate (axial). Such electrodes can create a fourth order correction to the electric field and by turning voltage on them it is possible to compensate a second order inhomogeneity of the magnetic field (see FIG. 1B. Computer experiments were performed with additional segments shaped by curves of even higher orders: sixth and eighth to z-coordinate for correction of higher order magnetic field inhomogeneity.)

It was shown that by varying the voltage on these additional electrodes it is possible to make the disturbances of the cyclotron frequency from the magnetic field inhomogeneity independent of the z-oscillation amplitude. The inhomogeneity of the magnetic field for the two Bruker magnets is represented in FIGS. 1C and 1D. It can be seen that in a small region near the center the magnetic field has a mainly linear inhomogeneity and for a larger z the quadratic inhomogeneity dominates.

It was shown that only the inhomogeneity of the magnetic field in its z direction has a considerable influence on cyclotron frequency. See Laukien, F. H.: *The Effects of Residual Spatial Magnetic Field Gradients on Fourier Transform Ion Cyclotron Resonance Spectra*, Int. J. Mass Spectrum. Ion Processes 73, 81-107 (1986); Anderson, W. A.: *Electrical Current Shims for Correcting Magnetic Fields. Rev. Sci. Instrum,* 32, 241-250 (1961). The effects of the inhomogeneity in radial directions are negligible. Therefore for a single ion inside the FT ICR trap the general equation for radial force balance for the simplified case of circular motion is:

$$m\omega^2 r=qB(r,z)v+qE_r(r,z) \tag{2}$$

Where m is ion mass, q is ion charge, B(r, z) is the intensity of magnetic field in the z direction, $E_r(r, z)$ is the radial component of the electric force formed by the ion trap, ω is the cyclotron frequency, r is cyclotron radius, z is coordinate in the direction along the magnetic field, and v is velocity. Divided by the cyclotron radius this equation becomes:

$$\frac{m\omega^2}{q}=B(r,z)\omega+\frac{E_r(r,z)}{r} \tag{3}$$

In case of the electric fields created by hyperbolic electrodes the cyclotron frequency does not depend on z. The dependence of the magnetic field B(r, z) and the radial component of the electric field $E_r(r, z)$ on the z coordinate causes the cyclotron frequency dependence on the z coordinate. As a consequence ions with different amplitudes of z oscillation have different cyclotron frequencies, and the ion cloud will experience dephasing during its cyclotron rotation. To prevent such dephasing the cyclotron frequency should be made independent of the z coordinate. Mathematically this means that its first derivative by z is equal to zero. The first derivative of Equation (3) by the z-coordinate is:

$$\frac{m}{q}2\omega\omega'_z=B'_z(r,z)\omega+B(r,z)\omega'_z+\left(\frac{E_r(r,z)}{r}\right)'_z \tag{4}$$

And by equalizing $\omega'_z$ to zero one obtains:

$$B'_z(r,z)\omega+\left(\frac{E(r,z)}{r}\right)'_z=0 \tag{5}$$

Taking into account that $$\omega = \frac{qB}{m},$$

one can rewrite Equation (5) in the following form:

$$\frac{q}{m}B'_z(r, z)B(r, z) + \left(\frac{E_r(r, z)}{r}\right)'_z = 0 \quad (6)$$

This is the equation describing the required relationship between the magnetic and the electric field in order for compensation to take place.

It is possible to describe the z component of the magnetic field for any magnet as a series of spherical functions as proposed by Anderson:

$$B_z = A_1^0 + 2A_2^0 z + 3A_2^1 x + 3B_2^1 y + 3A_3^0(2z^2 - x^2 - y^2)/2 + \ldots \quad (7)$$

Current shims of different geometry (circular, rectangular) are used for shimming different terms in expansion (7). Usually the main impact on the inhomogeneity of the magnetic field is caused by the quadratic term.

As a consequence, in order to simplify the task only the inhomogeneity of the magnetic field is considered in the following form:

$$B = B_0(1 + \gamma z^2) \quad (8)$$

The effects of other terms were not included in the current considerations. This field may be corrected by the electric potential of the form:

$$V = a + b(r^2 - 2z^2) + c(8z^4 - 24z^2r^2 + 3r^4) \quad (9)$$

This is a result of electric field representation as a series of spherical harmonics. By inserting this into the Equation (6), one obtains:

$$0 = B_0\gamma 2z\omega + \left(\frac{2br + c(-48z^2r + 12r^3)}{r}\right)'_z \quad (10)$$

This equation can be satisfied for $$c = \frac{eB_0^2\gamma}{48m} \quad (11)$$

So, the quadratic term of the magnetic field inhomogeneity can be compensated by the fourth order spherical harmonics of the electric field.

Figure 1B:
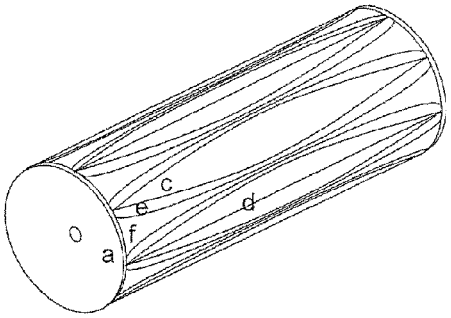
FIG. 1B illustrates the designs of the compensation ICR cell with dynamic harmonization. Letter e denotes extra electrodes for compensation of magnetic field inhomogeneity by an average radial electrostatic field; f are segments for electrostatic field harmonization; and c are grounded segments. As before electrodes are connected into groups for excitation and detection by slits d.
Figure 1C:
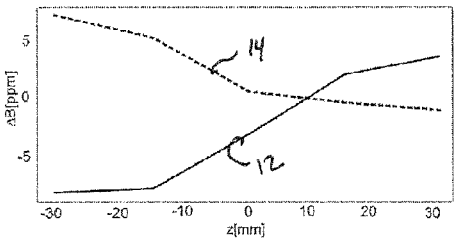
FIG. 1C illustrates the magnetic field near the center for two 7 Tesla Bruker magnets. Solid line 12, installed in Bremen, broken line 14, installed in Moscow. Magnetic field units are given in Tesla.
Figure 1D:
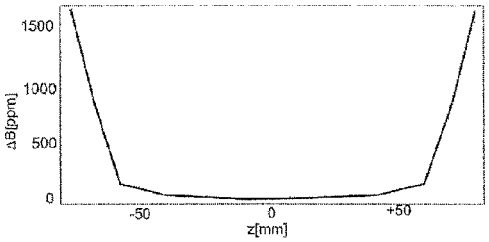
FIG. 1D illustrates the magnetic field for a 7 Tesla Bruker magnet installed in Bremen. Magnetic field units are given in Tesla.

The design of an ion trap capable to create such electric field is presented in FIG. 1B. Additional segments shaped by the fourth order curve are introduced into the original ion trap with dynamic harmonization. The form of the curve obeys the equation:

$$\alpha_4 = \frac{2\pi}{8}n \pm b_0\left(1 - \left(\frac{z}{k * a}\right)^4\right) \quad (12)$$

$$\text{with } b_0 = \frac{\pi}{7.2} - \frac{\pi}{60},\ k = 1.15.$$

If the potential on the compensation electrodes is set equal to the potential of the housing and trapping electrodes then the compensated cell becomes similar to the original cell with dynamic harmonization. So the same cell design may be successfully used for magnets of different homogeneity of the magnetic field. For magnets of high homogeneity the potential on the compensation electrodes will be close to the potential on the housing electrodes.

In the original ion trap with dynamic harmonization the trapping electrodes are shaped by following the equipotentials of the harmonic field. See Boldin, I. A., Nikolaev, E. N.: *Fourier Transform Ion Cyclotron Resonance Cell With Dynamic Harmonization of the Electric Field in the Whole Volume by Shaping of the Excitation and Detection Electrode Assembly*, Rapid Commun. Mass Spectrum. 25, 122-126 (2011); see also international patent application WO 2011/045144 A1. In the proposed cell with compensation electrodes the position of the trapping electrodes remained the same. This means that when the potential on the compensation electrodes is not equal to the potential on the housing electrodes the trapping electrodes do not fit the equipotential of the compensated field. This leads to the presence of additional corrections of a higher order in the electrostatic field.

It is possible to create an exact averaged compensated field of the form as given by Equation (9) by segmenting the trapping electrodes. Further details are set forth below.

Simulation of ion cloud dynamics in the cell with dynamic harmonization is a challenging problem. The time of transient duration for such a cell may reach 300 seconds. See Nikolaev, E. N., Boldin, I. A., Jertz, R., Baykut, G.: *Initial Experimental Characterization of a New Ultra-High Resolution FTICR Cell With Dynamic Harmonization*, J. Am. Soc. Mass Spectrum. 22(7), 1125-1133 (2011). During this time the ion accomplishes hundreds of million rotations. As a consequence for such long times even slight numerical errors in the calculated electromagnetic field or in the integration of ion motion equations will lead to a considerable difference between computer simulation results and experiment.

For example recently performed computer simulations of ion cloud motion in the original ion trap with dynamic harmonization showed a dephasing rate which was much faster than that observed experimentally. See Boldin, I. A., Nikolaev, E. N.: *Fourier Transform Ion Cyclotron Resonance Cell With Dynamic Harmonization of the Electric Field in the Whole Volume by Shaping of the Excitation and Detection Electrode Assembly*, Rapid Commun. Mass Spectrum. 25, 122-126 (2011); see also international patent application WO 2011/045144 A1. Further investigations showed that this dephasing occurred due to the dependence of the radial component of the electric force on the z coordinate. Such dependence occurred because of errors of the electrostatic potential calculations.

The potential distribution has been calculated by several methods: finite difference method (FDM) in cylindrical and Cartesian coordinates and finite element method (FEM). A multi-grid successive over-relaxation with optimal parameter method for FDM in Cartesian coordinates and multi-grid Gauss-Zeidel method for FDM in cylindrical coordinates was performed. A seven-point stencil was used for approximation of the Laplacian. To obtain high accuracy the size of the mesh, number of intermediate meshes and number of iterations were varied. Also SIMION 8 (David Manura Scientific Instruments Services, Ringoes, N. J., USA) has been applied for comparison.

The accuracy of the calculations was controlled by comparing the analytically obtained averaged field with the field obtained for the case when the voltage on the compensation electrodes was equal to the voltage on the housing and trapping electrodes. The comparing procedure was the following. For the original ion trap with dynamic harmonization with radius R and half-length Z the field averaged over the angle can be obtained as a solution for the system of equations:

$$V(r, z) = a + b(r^2 - 2z^2) \tag{13}$$
$$V(R, 0) = \frac{\pi}{60}\mathrm{V}$$
$$V(R, Z) = \mathrm{V}$$

Cylindrical symmetry of the cell suggests that the field averaged by the angle of rotation must be the solution of the averaged boundary problem. See Boldin, I. A., Nikolaev, E. N.: *Fourier Transform Ion Cyclotron Resonance Cell With Dynamic Harmonization of the Electric Field in the Whole Volume by Shaping of the Excitation and Detection Electrode Assembly*, Rapid Commun. Mass Spectrum. 25, 122-126 (2011); see also international patent application WO 2011/045144 A1. Here, V is the voltage on housing and trapping electrodes, and π/60—the angle width of the housing electrode in the center of the cell. By solving this system of equations one can easily calculate the theoretical field averaged by angle. It is convenient to compare the obtained results with the field given by Equation (13) on the central axis because the averaging procedure may cause additional errors.

The results obtained for field accuracy using different methods are shown below. Simulations have been performed for a cell with the following dimensions: radius of 28 mm, half-length of 75 mm, and radius of the trapping electrode of 148.7 mm. See Boldin, I. A., Nikolaev, E. N.: *Fourier Transform Ion Cyclotron Resonance Cell With Dynamic Harmonization of the Electric Field in the Whole Volume by Shaping of the Excitation and Detection Electrode Assembly*, Rapid Commun. Mass Spectrum. 25, 122-126 (2011); see also international patent application WO 2011/045144 A1. In the center of one of the trapping electrodes a circular hole of 6 mm in diameter for ion inlet was placed. The largest discrepancy between the numerically calculated field and the field given by set of Equations (13) on the central axis is defined as error.

FDM Cylindrical coordinates—Error=1.3%. Mesh corresponds to 2 points per 1 mm.

FDM Cartesian coordinates—Error=0.075%. Mesh corresponds to 12 points per 1 mm.

FEM—Error=0.65%. Mesh corresponds to 2 points per 1 mm.

SIMION—Errors 0.56%. Mesh corresponds to 10 points per 1 mm.

For all methods different mesh sizes limited only by available computer memory and different number of iterations were tried.

Also, comparison of the solutions in the whole volume of the cell has been performed. The numerically obtained field potential was averaged by the angle and compared to the field given by Equation (13). All methods showed close accuracy: for radii less than 70% of the cell the error is about 1%; for large radii the error is about 1.5%-2%. Additional details are set forth below.

The other possible source of errors is integration of ion motion equations. This integration was performed using a fourth order Runge-Kutta method with frequency correction. Realization of the frequency correction was similar to the one used in the Boris integration method. See Boris, J. P. *The Acceleration Calculation From A Scalar Potential*. Plasma Physics Laboratory: Princeton University, MATT-152, March (1970). Time step of integration was chosen from the condition that there are around 3000 calculation steps per one cyclotron period. For calculation of the electrostatic field inside the mesh element a trilinear interpolation method was used. See Kang, H. R.: *Computational Color Technology*, SPIE PRESS Bellingham, Wash. (2006). Also, numerous simulations in the hyperbolic field were performed in order to make sure that the integration procedure is not the source of errors.

To estimate the dephasing time of an ion cloud the following numerical experiment was carried out. The cyclotron motion during detection of ions with different m/q in a 7 T magnetic field with different cyclotron radii and oscillation amplitudes were simulated (the letter q used for the charge number instead of z in order to distinguish it from the axial metric).

The initial conditions for the equation of ion motion were the values of z coordinate, radius r, and corresponding cyclotron velocity v. The phase was the same for all of the experiments.

The z-oscillation amplitude was varied from 2 mm to 30 mm with 1 mm steps. Moments of ion intersection with the plane x=0 were recorded. Such method gives the possibility to monitor the evolution of the cyclotron frequency.

The time of complete ion cloud dephasing is defined as the time corresponding to the moment in the cloud evolution when the head of cloud touches its tail. One rotation cycle for ions with different oscillation amplitudes takes different times. If one denotes the mean length of the cyclotron period for these ions as $\bar{t}$ and the standard deviation which corresponds to the ion cloud dephasing rate as Δt, then the number of rotations required for complete dephasing is $N_{deph}=\bar{t}/\Delta t$. And the time of dephasing is:

$$T_{deph} = N_{deph} \bullet \bar{t} = \frac{\bar{t}^2}{\Delta t} \tag{14}$$

Results of the simulations are presented in FIGS. 2A-2F.

Figure 2:
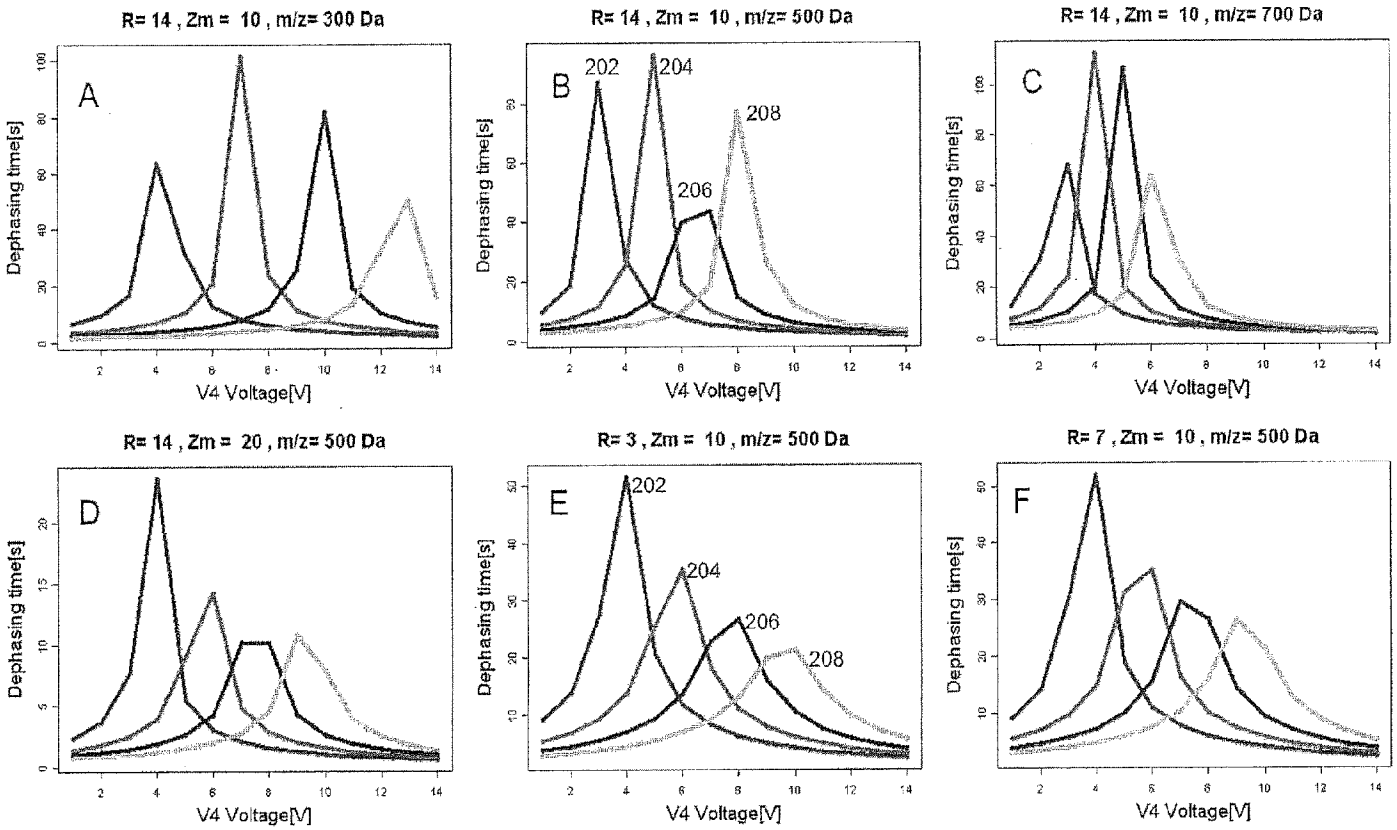
FIGS. 2A-2F illustrate the dependence of the ion cloud dephasing time on the compensation electrode voltage in case of a quadratic inhomogeneity $B=B_0(1+\gamma z^2)$ for different values of the z oscillation amplitude (zero to peak), radius and m/z Inhomogeneities (from left to right in all plots)
Figure 3:
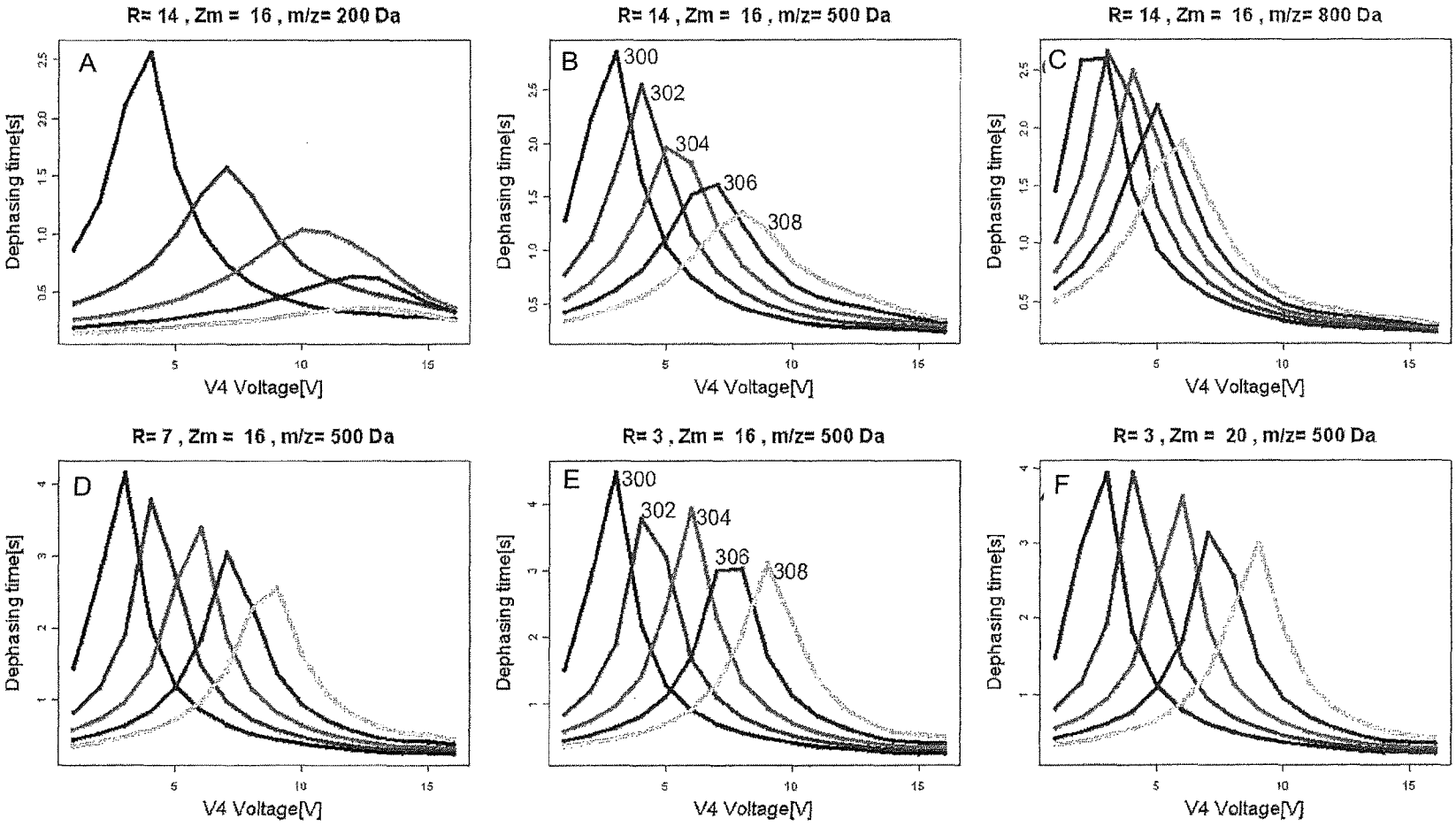

The voltage on the compensation electrodes does not depend on the amplitude of ion oscillation in the potential well along the magnetic field (FIGS. 2C and 2D). Also no dependence on cyclotron radius was observed (FIGS. 2D, 2E and 2F). An inversely proportional dependence of the optimal voltage on the compensation electrode from m/q (FIGS. 2A, 2B and 2C) and a linear dependence from the value of inhomogeneity of the magnetic field were observed as predicted by theory.

For example, for an inhomogeneity coefficient $\gamma=4\cdot10^{-9}$ $mm^{-2}$ the optimal compensation voltage is equal to 13 Volts for m/q=300, 8 Volts for m/q=500 and 6 Volts for m/q=700. The width at half height of the peaks on FIGS. 2A-2F is equal to approximately 1 Volt. This means that it can be expected that the proposed cell will effectively align the cyclotron frequency in an m/q range of about 100 Da for moderate m/q and for the whole upper m/q range.

The dependence of the dephasing time from the oscillation amplitude and radius, which can be seen in FIGS. 2A-2F, can be explained by numerical errors in the simulations of the electric field.

Simulations performed for the conventional ion trap with dynamic harmonization revealed an important rule that the accuracy of the electric field is the main factor influencing ion cloud dephasing. See Kostyukevich Y. Nikolaev E.,

*Studying of Ion Cloud Dephasing in FT ICR Trap With Dynamic Harmonization*, Proceedings of the 60th ASMS Conference on Mass Spectrometry and Allied Topics; Vancouver, Canada, May (2012).

It is also possible to compensate the linear inhomogeneity of the magnetic field using the proposed cell. For this it is necessary to set different potentials on the left and right compensation segments. The voltages on the compensation electrodes were changed in accordance with the following condition: $V_l+V_r=2\cdot V_{trap}$, where $V_{l,r}$—are the voltages on left and right sets of compensation electrodes and $V_{trap}$ is the voltage on the housing electrodes. Thus the compensation voltages on the left and right electrodes are symmetric with respect to the trapping voltage.

In FIGS. 3A-3F the results of such compensation are shown. It can be seen that for linear inhomogeneity it is possible to correct the cyclotron frequency and increase the time of synchronous ion motion. Also the inverse proportionality of the dependence from m/q and linear dependence from the inhomogeneity coefficient can be seen. The compensation works only for a certain m/q range. The average order of such m/q range is approximately hundreds of Dalton. The complete compensation may be done for much narrower m/q range (which is enough in case of fine structure resolution and isotopic patterns of proteins).

In order to compare these results with the compensation theory the following computational experiment was done. The z coordinates were frozen and the values of the magnetic field, electric force and current coordinates of the ions during their rotation were recorded. Approximately 150 records per cyclotron period were made.

For each z coordinate the mean radial component of the electric field $E_r(z)$ was calculated. The compensation theory predicts that in order for compensation to occur, (as follows from Equation (6)) the following condition must be met:

$$\omega_c B'_z(z) + \frac{E'_z(z)}{r} = 0 \tag{15}$$

If derivative $E'_z(z)$ is replaced with a finite difference $$\Delta E(z) = \frac{E(z) - E(0)}{z}$$

and similar is done for $B'_z(z)$, it may be concluded that curves $\omega_c(B(z)-B(0))$ and $$\frac{E(z) - E(0)}{r}$$

should match in order to meet the compensation condition. From FIGS. 4A-4B it can be seen that by adjusting the compensation electrode voltage one can almost satisfy these conditions.

It can be clearly seen that for each z coordinate the inhomogeneity of the magnetic field was compensated by a correction in the electric force.

Compensation of the magnetic field inhomogeneity inside an FT ICR cell with dynamic harmonization by introducing specific electric field corrections is presented. An ICR cell design is proposed in which the inhomogeneous component of the magnetic field of the second order is compensated by an electric field, created by incorporating into the housing electrode assembly, electrodes which borders are shaped by a fourth order curve. By setting different voltages on the left and right set of compensation electrodes, it is also possible to compensate a linear inhomogeneity. Computer simulations have shown that in the proposed cell design the inhomogeneity of the magnetic field can be effectively compensated in a relatively large mass to charge ratio range and a considerable increase in the resolving power in the case of low homogeneity of the magnetic field may be obtained.

The idea to create a cell providing an averaged field Equation (9) is based on the principle of a dynamic field. A schematic design is presented in FIG. 5A-5B. Only the second and fourth corrections of the electric field were considered. The consideration of higher harmonics is the same. Instead of a circular trapping electrode a segmented flat trapping electrode was proposed. The cylindrical surface is the same as in the original cell with dynamic harmonization. The trapping electrode is flat but is segmented into sectors by curves of the second and fourth order. The schematic design of the cell does not include gaps between electrodes. Also for the case of simplicity the width of housing electrodes in the center of the cell is considered to be zero.

To determine the relationship between the voltages and parameters of the field Equation (9), the field must be averaged by angle. Using definitions from FIGS. 5A-5B on the cylindrical surface one can obtain:

$$V(R, z) = a + b(R^2 - 2z^2) + c(8z^4 - 24z^2R^2 + 3R^4) = \frac{N}{\pi}\left(V_4\frac{\frac{\pi}{N}}{L^4}z^4 + V_2\left(\frac{\frac{\pi}{N}}{L^2}z^2 - \frac{\frac{\pi}{N}}{L^4}z^4\right) + V_0\left(\frac{\pi}{N} - \frac{\frac{\pi}{N}}{L^2}z^2\right)\right) \tag{16}$$

An averaged field on the trapping electrode:

$$V(r, L) = a + b(r^2 - 2L^2) + c(8L^4 - 24L^2r^2 + 3r^4) = \frac{N}{\pi}\left(V'_4\frac{\frac{\pi}{N}}{R^4}r^4 + V'_2\left(\frac{\frac{\pi}{N}}{R^2}r^2 - \frac{\frac{\pi}{N}}{R^4}r^4\right) + V'_0\left(\frac{\pi}{N} - \frac{\frac{\pi}{N}}{R^2}r^2\right)\right) \tag{17}$$

By equalizing Equations (16) and (17), the following system of equations for the potentials on the electrodes can be obtained:

$$\begin{cases} \frac{(V_4 - V_2)}{L^4} = 8c \\ \frac{(V_2 - V_0)}{L^2} = -2b - 24cR^2 \\ V_0 = a + bR^2 + 3cR^2 \end{cases} \quad \begin{cases} \frac{(V'_4 - V'_2)}{R^4} = 3c \\ \frac{(V'_2 - V'_0)}{R^2} = b - 24cL^2 \\ V'_0 = a - 2bL^2 + 8cL^4 \end{cases} \tag{18}$$

As can be seen by solving this system of equations it is possible to adjust the potentials on the electrodes to create a field of the exact form (Equation (9)). The same technique is applicable to create a field of any other cylindrically symmetric form by introducing additional segments shaped by curves of higher order.

In this section a detailed discussion of the calculations of the electrostatic field is presented.

Several different methods were applied to obtain a very high accuracy in the procedure of the electric field simulation. The simplest one is the FDM method in a Cartesian coordinate system. The main disadvantage of this method is the error of approximation of the electrodes on the mesh. A simple shift method was used for approximating the boundary conditions, so the approximation error is of the order of the mesh size. See Samarskii, A. A: *Theory of difference schemes*. Nauka, Moscow (Russian) (1989). But the important advantage is that the mesh is uniform and iterative methods for solving the boundary problem can converge very fast. A seven-point stencil was used for approximating the Laplace operator on the mesh, and also experiments with a 19-point stencil were carried out and no considerable difference was found. See O'Reilly, R. C., Beck, J. M., *A Family of Large-Stencil Discrete Laplacian Approximations in Three-Dimensions*, Int. J. Numer. Methods Eng. 1-16 (2006).

The electrostatic potential was calculated in the sector $\phi\in[0,(\pi/2)]$ on a uniform mesh. If the mesh approximation of the potential on a mesh point with indices $x_n$, $y_m$, $z_k$ is denoted as $u_{n,m,k}$, then one step of the numerical solution was setting the value in this point as follows (see Samarskii, A. A., Andreev, V. B.: *The Different Methods For Elliptic Equations*, Nauka, Moscow (Russia) (1976)):

$$u_{n,m,k} = (1-w)u_{n,m,k} + w\left(\frac{u_{n-1,m,k}+u_{n+1,m,k}+u_{n,m-1,k}+u_{n,m+1,k}+u_{n,m,k-1}+u_{n,m,k+1}}{6}\right) \tag{19}$$

Where parameter w is defined as:

$$w = \frac{2}{1+\sqrt{2-2\left(\sin^2\left(\frac{\pi}{2N}\right)+\sin^2\left(\frac{\pi}{2M}\right)+\sin^2\left(\frac{\pi}{2K}\right)\right)}} \tag{20}$$

And N, M, K—are the maximal numbers of points on the mesh in the x, y and z directions.

One step of numerical solving a boundary problem is applying formula (19) for all grid points. This is a well-known successive over-relaxation method with optimal parameter. See Samarksii (1989) and Samarksii (1976) identified herein. In order to increase the convergence a multi grid method was used. First the solution was obtained on a rough grid and then this solution was used as the initial condition for an iterative method on a fine grid. Different ways of choosing intermediate grids and different numbers of iteration on them were used.

One way to escape approximation errors is by implementing FDM in cylindrical coordinates. In addition, rotation symmetry allows to considerably save computer memory by solving the problem only in the region $\phi\in[0,(\pi/N_{sec})]$, where $N_{sec}$ is the number of sectors. As a consequence, it is possible to use finer meshes with more points in them. For electrode approximation a simple shift method was used. The approximation of electrodes on cylinder surface does not contain errors except for the region around shaping curve. And the trapping electrodes are still approximated with errors of the order of mesh size.

A Gauss-Zeidel iterative method was used to solve a system of algebraic equations. If the grid approximation of the potential value in a certain point of the grid with indices $r_n$, $\phi_m$, $z_k$ is denoted as $u_{n,m,k}$ then one step of the numerical solution was setting the value in this point as follows (see Samarksii (1989)):

$$u_{n,m,k} = \frac{\beta}{2+4\beta}\left(\begin{array}{l} n^2(u_{n-1,m,k}+u_{n+1,m,k})+\frac{n}{2}(u_{n+1,m,k}-u_{n-1,m,k})+ \\ +\frac{1}{\beta}(u_{n,m-1,k}+u_{n,m+1,k})+n^2(u_{n,m,k-1}+u_{n,m,k+1}) \end{array}\right) \tag{21}$$

Here $$\beta = \frac{\pi^2}{N_{sec}^2 M},$$

$N_{sec}$ is the number of sectors (eight in our case), and M is a maximal number of points of angle discretization. One cycle of the calculations (iteration) is applying expression (21) to all mesh points. To increase the convergence a multi grid method was used.

But approximation of the trapping electrodes still contains errors. Attempts of obtaining high accuracy using this method were not successful because iterative methods did not converge for large meshes. But in case of small meshes the solution was more accurate, as compared to the one obtained for FDM in Cartesian coordinates with equal mesh size.

A method that does not have approximation errors is FEM. In addition to the surface elements corresponding to electrode boundary especially curved cylindrical elements were used. But the accuracy of this method also was not very high.

The best results were obtained using FDM in Cartesian coordinates for a very fine mesh. In FIG. 6, the variation of the ratio $E_r(z)/r$ averaged over the angle along the central axis is presented. In an ideal cell the ratio $E_r(z)/r$ should be independent of both z and r. But because of the calculation errors in the electrostatic field certain dependence is observed.

It can be seen that the variation of $E_r(z)/r$ considerably depends on the accuracy of the calculated electric field. The radial component of the electric field is the derivative of the electric potential by the radius and derivation introduces additional errors. The field from a rectangular mesh was interpolated to a cylindrical one and then a four-point derivative was used to obtain the electric force in the radial direction.

The invention has been described with reference to a number of different embodiments thereof. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

What is claimed is:

1. A method of magnetic field inhomogeneity compensation in a FT-ICR cell, with housing electrodes alternately increasing and decreasing in width from ends to a center of the cell, thus creating a dynamically harmonized electric field, the improvement comprising an adding of extra electrodes into the cell, wherein the extra electrodes are shaped on one side by curves of fourth or higher order in the axial direction z such that an average electric field created by a voltage at these extra electrodes produces a counter force to forces caused by second order or, respectively, higher than second order magnetic field inhomogeneities in the axial direction z on ions cycling within the cell.

2. The method of claim 1, wherein the extra electrodes are inserted between the housing electrodes with decreasing width and those with increasing width on a cylinder surface surrounding the FT-ICR cell.

3. The method of claim 1, wherein the housing electrodes with widths increasing to the center have boundaries with curves of second order in the axial direction z.

4. The method of claim 1, wherein the housing electrodes with widths decreasing to the center have boundaries with curves of fourth order in the axial direction z.

5. The method of claim 1, wherein the housing electrodes with width increasing to the center are grounded.

6. The method of claim 1, wherein housing electrodes of the dynamically harmonized FT-ICR cell form a cylinder which is segmented into electrodes of different types by curves along the axial direction z, which coincides with the direction of the magnetic field, the curves fulfilling the requirement $$\alpha = \frac{2\pi}{N} n \pm b\left(1 - \left(\frac{z}{a}\right)^2\right); n = 0, 1, \ldots, N-1; \quad b = \pi/N - \pi/60;$$

where a is half the length of the cell, α an angle coordinate of a point on the curve, and N a number of electrodes of each type.

7. The method of claim 1, wherein trapping electrodes at the ends of the FT-ICR cell are radially segmented, and the extra electrodes are inserted between these segments.

8. The method of claim 1, further comprising varying the voltage on the extra electrodes in order to make disturbances of a cyclotron frequency caused by the magnetic field inhomogeneity independent of a z-oscillation amplitude.

9. A method of compensating a magnetic field inhomogeneity inside an FT ICR cell with dynamic harmonization by introducing a specific electric field correction, comprising: incorporating into a housing electrode assembly electrodes the borders of which on one side are shaped by a curve of fourth order in an axial direction of the cell, which coincides with a direction of the magnetic field; and compensating an inhomogeneous component of the magnetic field of the second order by an electric field created by voltages applied to the special electrodes.

10. An improved dynamically harmonized FT ICR cell having a shape of a cylinder being made up of electrodes of different types which are folioed by curves along an axial direction z of the cylinder, the axial direction coinciding with a direction of the magnetic field and the curves fulfilling the requirement $$\alpha = \frac{2\pi}{N} n \pm b\left(1 - \left(\frac{z}{a}\right)^2\right); n = 0, 1, \ldots, N-1; \quad b = \pi/N - \pi/60;$$

where a is half the length of the cell, α an angle coordinate of a point on the curve, and N a number of electrodes of each type, the cell further comprising extra electrodes being located between the electrodes of different types and the borders of which being shaped on one side by curves of an order four or higher in z, and further being supplied with an electric potential in order to compensate for magnetic field inhomogeneities of order two or higher, respectively, in the direction z of the magnetic field.

11. The cell of claim 10, wherein the cylinder is closed by two trapping electrodes with a surface geometry close to spherical.

12. The cell of claim 10, wherein different electric potentials are set on left and right extra electrodes, the different potentials fulfilling the requirement $V_l+V_r=2\cdot V_{trap}$, where $V_{l,r}$ are the voltages on left and right sets of the extra electrodes and $V_{trap}$ is the voltage on cylinder electrodes of different types.

* * * * *